US010113432B2

(12) United States Patent
Holzhaeuser et al.

(10) Patent No.: US 10,113,432 B2
(45) Date of Patent: Oct. 30, 2018

(54) ROTOR SHAFT WITH COOLING BORE INLETS

(71) Applicant: ANSALDO ENERGIA SWITZERLAND AG, Baden (CH)

(72) Inventors: Steffen Holzhaeuser, Nussbaumen (CH); Carlos Simon-Delgado, Baden (CH); Carl Berger, Wettingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 400 days.

(21) Appl. No.: 14/661,220

(22) Filed: Mar. 18, 2015

(65) Prior Publication Data

US 2015/0267542 A1 Sep. 24, 2015

(30) Foreign Application Priority Data

Mar. 19, 2014 (EP) ..... 14160615

(51) Int. Cl.
*F01D 5/18* (2006.01)
*F01D 5/06* (2006.01)
(Continued)

(52) U.S. Cl.
CPC ..... *F01D 5/18* (2013.01); *F01D 5/02* (2013.01); *F01D 5/063* (2013.01); *F01D 5/087* (2013.01);
(Continued)

(58) Field of Classification Search
CPC ..... F01D 5/081; F01D 5/085; F01D 5/087
See application file for complete search history.

(56) References Cited

U.S. PATENT DOCUMENTS 2,657,902 A * 11/1953 Williams ..... F01D 5/021 29/889.2
4,102,603 A 7/1978 Smith et al.
(Continued)

FOREIGN PATENT DOCUMENTS

| | | |
|---|---|---|
| DE | 697 045 C | 10/1940 |
| EP | 0 926 311 A1 | 6/1999 |
| EP | 2 246 525 A1 | 11/2010 |

OTHER PUBLICATIONS

The extended European Search Report dated Sep. 4, 2015, by the European Patent Office in corresponding European Patent Application No. 15156738.5-1610. (7 pages).
(Continued)

*Primary Examiner* — Ninh H Nguyen
*Assistant Examiner* — Brian O Peters
(74) *Attorney, Agent, or Firm* — Buchanan Ingersoll & Rooney PC

(57) ABSTRACT

The invention relates to a rotor shaft adapted to rotate about a rotor axis thereof. The rotor shaft includes a rotor cavity configured concentrically or quasi-concentrically to the rotor axis inside the rotor shaft, and a plurality of cooling bores extending radially or quasi-radially outward from the inside to an outside of the rotor shaft. Each cooling bore having a bore inlet location and a distal bore outlet portion, the respective bore inlet location being adapted to abut on the rotor cavity. At least one side or part-side of the cooling bore inlet location is provided with an asymmetric edge fillet in order to maximize the wall thickness between two adjacent cooling bores.

14 Claims, 3 Drawing Sheets

(51) Int. Cl.
*F01D 5/08* (2006.01)
*F01D 5/02* (2006.01)
*F01D 25/12* (2006.01)

(52) U.S. Cl.
CPC ..... *F01D 25/12* (2013.01); *F05D 2220/31* (2013.01); *F05D 2220/32* (2013.01); *F05D 2230/10* (2013.01); *F05D 2240/60* (2013.01); *F05D 2260/232* (2013.01); *F05D 2260/941* (2013.01)

(56) References Cited

U.S. PATENT DOCUMENTS 4,203,705 A 5/1980 Wesbecher
4,344,738 A 8/1982 Kelly et al.
4,522,562 A 6/1985 Glowacki et al.
5,507,620 A 4/1996 Primoschitz et al.
5,704,764 A 1/1998 Chupp et al.
6,808,362 B1 10/2004 Glahn et al.
8,628,292 B2 1/2014 Maltson
2005/0265841 A1* 12/2005 Magowan ..... F01D 5/081 416/97 R
2007/0086884 A1 4/2007 Wiebe et al.
2010/0162564 A1* 7/2010 Storch ..... B23C 3/34 29/889
2010/0326039 A1* 12/2010 Arase ..... F01D 5/081 60/39.01
2013/0280093 A1* 10/2013 Zelesky ..... B22C 9/10 416/97 R

OTHER PUBLICATIONS

Office Action (First Office Action) dated Jun. 30, 2017, by the Chinese Patent Office in corresponding Chinese Patent Application No. 201510118327.3, and an English Translation of the Office Action. (13 pages).

* cited by examiner

ROTOR SHAFT WITH COOLING BORE INLETS

CROSS-REFERENCE TO RELATED APPLICATIONS

This application claims priority to European application 14160615.2 filed Mar. 19, 2014, the contents of which are hereby incorporated in its entirety.

TECHNICAL FIELD

The present invention relates to the field of rotating machines, and, more particularly, to a rotor shaft for a turbo-machinery, especially for a gas or steam turbine. The rotor shaft comprising a rotor cavity configured concentrically or quasi-concentrically to the rotor axis inside the rotor shaft, and a plurality of cooling bores extending radially or quasi-radially outward from the inside to an outside of the rotor shaft. Each cooling bore having a bore inlet location and a distal bore outlet portion. The respective bore inlet location being adapted to abut on the rotor cavity.

BACKGROUND

Fundamentally, compressors, gas turbines, steam turbines and other thermal machines are subjected to high thermal and mechanical stresses. Accordingly, it is indispensable to reduce such thermal and mechanical stresses.

In a gas turbine, a rotor shaft, among the various other parts, such as rotor blades and stator vanes, are exposed to high thermal and mechanical stresses. Critical locations may be, among others, cooling bore inlets in rotor cavities of the rotor shaft. Generally, the rotor cavities are configured inside of the rotor shaft, and the cooling bore inlets are arranged on outer circumference of such rotor cavities. The cooling bores extend from the inside of the rotor shaft mainly in a radial direction. Where such cooling bores and rotor cavities are concerned, the stresses arising in the rotor cavities depend critically on a cross-sectional contour of the rotor cavities.

The cooling bores usually constitute a mechanical weakening of the rotor shaft in the area where they extend from the rotor cavities, which may have an adverse effect in the case of high thermal and mechanical stresses.

Accordingly, there are a number of measures which have already been contemplated to reduce the effects of thermal and mechanical stresses, namely:

Reduction of the bore diameters and change of the bleed position within the compressor for realize a higher stage. But this impact increases the cooling air pressure and thus reduces the required cross section of the flow. Referring to the drawbacks this induces a negative performance impact and, additionally, this increases the cooling air temperature.

Change of the SAF system, e.g. change of the blade feed to the front of the blade instead of the bottom. Referring to the drawbacks this requires a redesign of the rotor and/or rotor blades and/or stator vanes. Additionally, the pressure losses must be recuperated with other setups.

The internal radial compressor of the rotor is provided in the form of ribs on the rotor cavity wall. The internal ribs accelerate the air flow in circumferential direction and thus increase its swirl. Referring to the drawbacks this comports that the ribs have a very high surface to volume ratio and thus have a very fast thermal behaviour while the rotor disc with a very low surface to volume ratio has a very slow thermal behaviour. This can introduce very high thermal stresses into the rotor disc so that the design of such ribs results difficult.

In summary it can be said that a high number of big holes lead to limited rotor lifetime due to a low remaining wall thickness between neighboring bores. Furthermore, the high jump of the relative velocity of the cooling air at the inlet of the cooling bore leads to pressure losses and a bigger required bore diameter due to recirculation.

SUMMARY

The present invention describes an improved rotor shaft of a gas turbine, steam turbine or, generally, turbo-machinery, that will be presented in the following simplified summary to provide a basic understanding of one or more aspects of the disclosure that are intended to overcome the discussed drawbacks, but to include all advantages thereof, along with providing some additional advantages.

This summary is not an extensive overview of the invention. It is intended that neither identify key or critical elements of the invention, nor to delineate the scope of the present disclosure. Rather, the sole purpose of this summary is to present some concepts of the invention, its aspects and advantages in a simplified form as a prelude to the more detailed description that is presented hereinafter.

An object of the present invention is to describe an improved rotor shaft, which may be adaptable in terms of reducing effect of thermal and mechanical stresses arise thereon while a machine or turbine in which relation it is being used is in running condition.

Further, independently of the fact whether the rotor shaft of the present invention being made of single piece or of multiple piece, the rotor shaft of the present invention has an objective of withstanding or reducing effects of thermal and mechanical stresses.

Another object of the present invention is to describe an improved rotor shaft, which is convenient to use in an effective and economical way. Various other objects and features of the present invention will be apparent from the following detailed description and from the claims.

Summary, according to the characterizing clause of the independent claim the main aspects of the inventive step include a first embodiment that at least one side or part-side of the cooling bore inlet location is provided with an asymmetric edge fillet in order to maximize the wall thickness between two adjacent cooling bores.

The above noted and other objects, in one aspect, may be achieved by an improved rotor shaft for a gas turbine engine of a power plant. The rotor shaft adapted to rotate about a rotor axis thereof. The rotor shaft includes a rotor cavity configured concentrically or quasi-concentrically to the rotor axis inside the rotor shaft. It is to be understood that the invention is not to be strictly limited to a concentrically cavity configuration.

The rotor shaft further includes a plurality of cooling bores extending radially or quasi-radially outward from the inside to an outside of the rotor shaft. It is to be understood that the invention is not to be strictly limited to a radially configuration. Each cooling bore includes a bore inlet portion and a distal bore outlet portion. The respective bore inlet portions being adapted to abut on the rotor cavity. The bore itself (between the inlet portion and the outlet portion) is a "normal" straight bore with a constant bore diameter.

The rotor shaft in one embodiment may be a single piece configuration or in another embodiment may be a two or more pieces configuration welded to be assembled along at least one weld seam. The rotor shaft could also be bolted together.

Moreover, the present invention introduces an asymmetric edge filet at the inlet of a cooling bore in the cavity of the rotor. The cooling air flows through a centre, or quasi-center, or other disposed bore into a rotor cavity and enters the cooling air bores which guide it towards rotor blades.

The rotational velocity of the cooling air is only small in the rotor cavity. In the transition from the cavity to the cooling bores, the rotational velocity of the cooling air increases significantly which leads to pressure losses and recirculation areas at the bore inlet.

The introduction of the asymmetric edge fillet allows for a smoother transition from the rotor cavity to the cooling bores and thus improves the flow conditions at the bore inlet. The disclosed inlet design of the cooling holes is used to guide the air through the rotor disc and not for pressurizing the air.

The recirculation areas are reduced and, thus, the effective flow cross section in the cooling bore inlet is increased. This limits the peak-velocities to smaller values and reduces the pressure losses significantly.

For that reason, the cooling bore diameter can be reduced while the cooling air velocity and pressure losses stay the same or increase only slightly.

Due to the high number of cooling bores, the remaining wall thickness between neighboring bores is only low which limits the rotor lifetime in this location. In order to keep the minimum wall thickness as big as possible, the edge fillet is only applied on one side of the bores and is thus asymmetric while the other side remains basically without fillet, but basically does not mean fundamentally, i.e. within a narrow range, the side which is available without fillet can be provided with a reduced edge fillet without sacrificing the predominant underlying asymmetry.

Referring to the asymmetry the side comprising the edge fillet is applied at the front of the bore in direction of rotation of the rotor.

The features of the present invention can be combined with additional feature in order to optimize in further manner the rotor lifetime, namely:

The rotor shaft comprising a rotor cavity configured concentrically to the rotor axis inside the rotor shaft and a plurality of cooling bores extending radially outward from the inside to an outside of the rotor shaft. Each cooling bore having a bore inlet portion and a distal bore outlet portion, and the respective bore inlet portion is adapted to abut on the rotor cavity. Furthermore, the rotor cavity comprises a cross-sectional profile adapted to be circumferentially straight at a location whereas the each respective bore inlet portion abuts on the rotor cavity, enabling reduction in at least thermal and mechanical stresses across the major cross-sectional profile of the rotor cavity.

Moreover, the rotor shaft can be configured as a single piece configuration, or the rotor shaft is configured in two or more pieces, welded to be assembled along one welded seam.

The edge fillet referring to the asymmetric side of the bore is ideally manufactured as a round fillet with a radius between factor 0.3 to 0.7 Of the cooling bore diameter. Due to manufacturing limitations, the round fillet can be approximated by 3 or more chamfers with uniform angular steps in between. In case the fillet is approximated by chamfers, the overall width w and the overall depth d of the edge fillet are also between factor 0.3 and 0.7 of the cooling bore diameter.

Accordingly, the final aim of the present invention consists in introduction of an asymmetric edge fillet at the inlet of a rotating cooling bore in a rotor disc in order to improve the flow conditions at the inlet and, thus, to reduce the inlet pressure losses, allowing for a smaller bore diameter for a given mass flow. Accordingly, the remaining wall thickness between neighboring bores is improved which is beneficial for the rotor lifetime.

The above explained statements together with the other aspects of the present disclosure, along with the various features that characterize the present invention, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawing, wherein like elements are identified with like symbols, and in which:

DETAILED DESCRIPTION

Figure 1:
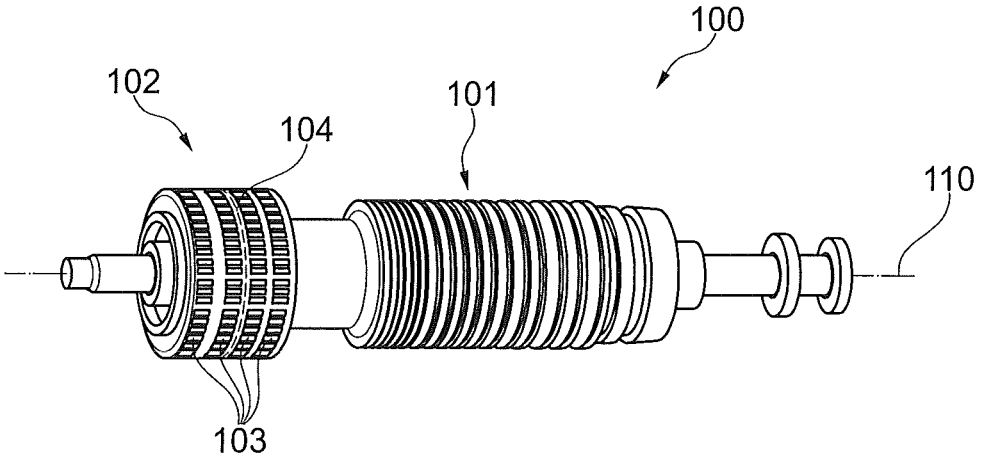
FIG. 1 shows a perspective side view of a rotor shaft of a gas turbine.

FIG. 1 reproduces a perspective side view of the rotor shaft 100, without blading, of a gas turbine and will be described in conjunction to FIG. 2. The rotor shaft 100, rotationally symmetric with respect to a rotor axis 110, is subdivided into a compressor part 101 and a turbine part 102. Between the two parts 101 and 102, inside the gas turbine dome, a combustion chamber may be arranged, into which air compressed in the compressor part 101 is introduced and out of which the hot gas flows through the turbine part 102. The turbine part 102, arranged one behind the other in the axial direction, has a plurality of rotor disks 103, in which axially oriented reception slots for the reception of corresponding moving blades are formed so as to be distributed over the circumference. Blade roots of the blades are held in the reception slots in the customary way by positive connection by means of a fir tree-like cross-sectional contour. The rotor cavity (see FIG. 2) may be connected to a central cooling air supply 104 running in an axial direction within the rotor shaft 100 to supply cool air therefrom to the rotor cavity, and there to the plurality of cooling bores (see FIG. 2).

Figure 2:
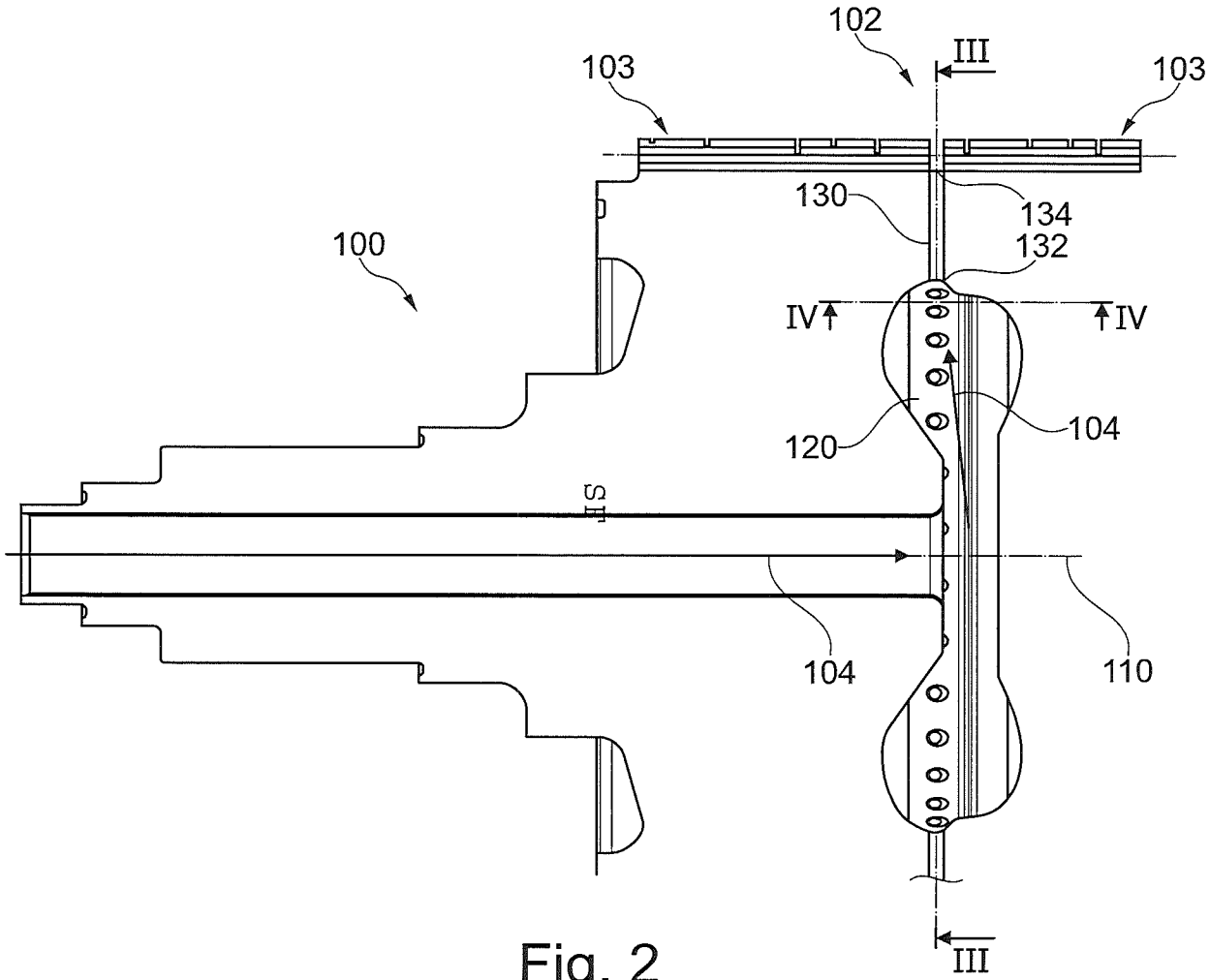
FIG. 2 shows a longitudinal section through the rotor shaft in accordance with FIG. 1, and illustrates an example referring to a rotor cavity having a number of cooling bores.

Basically, according to FIG. 2, the rotor shaft comprising a rotor cavity configured concentrically to the rotor axis inside the rotor shaft and a plurality of cooling bores extending radially outward from the inside to an outside of the rotor shaft. Each cooling bore having a bore inlet portion and a distal bore outlet portion, and the respective bore inlet portion is adapted to abut on the rotor cavity. Furthermore, the rotor cavity comprises a cross-sectional profile adapted to be circumferentially straight at a location whereas the each respective bore inlet portion abuts on the rotor cavity, enabling reduction in at least thermal and mechanical stresses across the major cross-sectional profile of the rotor cavity.

In connection with FIG. 2 the rotor cavity 120 is configured concentrically to the rotor axis 110 inside the rotor shaft 100, according to FIGS. 1 and 2. Further, the plurality of cooling bores 130 is configured in a manner that extend radially outward from the inside to an outside of the rotor shaft 100. Each cooling bore 130 includes a bore inlet portion 132 and distal bore outlet portion 134. The respective bore inlet portion 132 being adapted to abut on the rotor cavity 120. The term 'abut' is defined to mean that the bore inlet portion 132 and the rotor cavity 120 whereat the bore inlet portion 132 meets share a same plane. On the one part, the rotor cavity 120 may be connected to a central cooling air supply 104 running in an axial direction within the rotor shaft 100 to supply cool air therefrom to the rotor cavity 120, and there to the plurality of cooling bores 130. On the other part, the air could be delivered to the cavity differently. The cool air from the plurality of cooling bores 130 reaches the outside of the rotor shaft 100 between the blades and blade roots 103 for cooling thereto.

Figure 3:
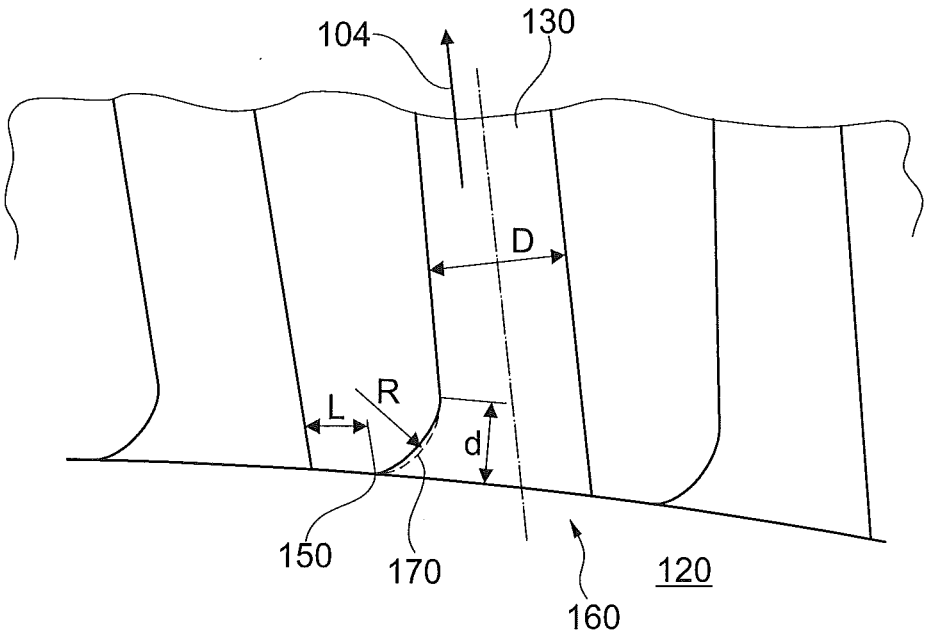
FIG. 3 shows a partial view of the rotor cavity, depicting an embodiment of the invention with an asymmetric configuration of the cooling bores over a conventional rotor cavity in accordance with section view of FIG. 2.

FIG. 3 shows a most preferred embodiment of the present invention in accordance with section view of FIG. 2. The present embodiment introduces an asymmetric edge filet 150 at an inlet location of a cooling bore 130 in the rotor cavity 120. The cooling air flows through a different placed bore into a rotor cavity and enters the cooling air bores which guide it towards rotor blades (see FIG. 2).

The rotational velocity of the cooling air is only very small in the rotor cavity. In the transition from the cavity to the cooling bores, the rotational velocity of the cooling air increases significantly which leads to pressure losses and recirculation areas at the bore inlet location 160.

The introduction of the asymmetric edge fillet 150 allows for a smoother transition from the rotor cavity 120 to the cooling bores 130 and thus improves the flow conditions at the bore inlet location.

The recirculation areas are reduced and, thus, the effective flow cross section in the cooling bore inlet location 160 is increased. This limits the Mach-number to smaller values and reduces the pressure losses significantly.

For that reason, the cooling bore diameter D (see also FIG. 4) can be reduced while the cooling air velocity and pressure losses stay the same or increase only slightly.

Due to the high number of cooling bores 130, the remaining wall thickness L (see also FIG. 4) between neighboring bores is only low which limits the rotor lifetime in this location. In order to keep the minimum wall thickness as big as possible, the edge fillet 150 is only applied on one side of the bores and is thus asymmetric while the other side remains basically without edge fillet, in order to keep the minimum wall thickness as big as possible, i.e. at least one side or part-side of the circumferential area of the cooling bore inlet 160 are provided with an asymmetric edge fillet 150 in order to maximize the wall thickness downstream of the edge fillet between two adjacent cooling bores.

Referring to the asymmetry the side comprising the edge fillet 150 is applied at the front of the cooling bore 130 in direction of rotation of the rotor.

The edge fillet 150 referring to the asymmetric side of the bore 130 is ideally milled, wherein each other manufacturing is also possible, as a round fillet with a radius R (item 170) between factors 0.3 to 0.7 of the cooling bore diameter a The cooling bore 130 comprising a constant cooling bore diameter D in the region between the first end of said bore inlet location 160 which is located in the direction to the bore outlet portion 134 and said bore outlet portion 134. As described above the opposite second end of the bore inlet location 160 abuts on the rotor cavity 120.

Due to manufacturing limitations, the round fillet can be approximated by 3 or more milled chamfers with uniform angular steps in between. In case the fillet is approximated by chamfers, the overall width w (see FIG. 4) and the overall depth d of the edge fillet are also between factor 0.3 and 0.7 of the cooling bore diameter D.

Accordingly, the final aim of the present invention consists in introduction of an asymmetric edge fillet at the inlet of a rotating cooling bore in a rotor disc in order to improve the flow conditions at the inlet and, thus, to reduce the inlet pressure losses, allowing for a smaller bore diameter for a given mass flow. Accordingly, the remaining wall thickness between neighboring bores is improved which is beneficial for the rotor lifetime.

Figure 4:
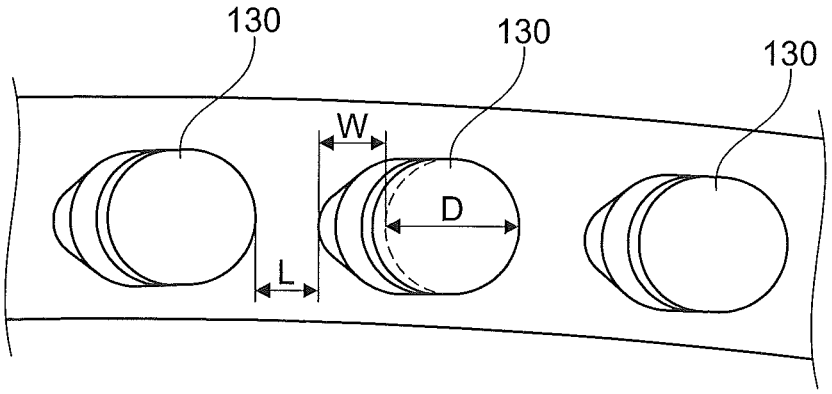
FIG. 4 shows an asymmetric configuration of the cooling bores in accordance with a partial section view IV-IV of FIG. 2.

FIG. 4 shows the embodiment of the present invention in accordance with section view IV-IV of FIG. 2, in order to keep the minimum wall thickness as big as possible with respect to the high number of cooling bores 130, the edge fillet 150 is only applied on one side or part-side of the bores and is thus asymmetric while the other side remains basically without edge fillet, in order to keep the minimum wall thickness as big as possible.

The edge fillet (see also description under FIG. 3) referring to the asymmetric side of the bore 130 is ideally milled as a round fillet with a radius between factors 0.3 to 0.7 of the cooling bore diameters D. Due to manufacturing limitations, the round fillet can be approximated by 3 or more milled chamfers with uniform angular steps in between. In case the fillet is approximated by chamfers, the overall width w and the overall depth d (see FIG. 4) of the edge fillet are also between factor 0.3 and 0.7 of the cooling bore diameter D.

The improved rotor shaft of the present invention, especially with respect to the both described embodiments, is advantageous in various scopes. The rotor shaft may be adaptable in terms of reducing effect of thermal and mechanical stresses arise thereon while a machine or turbines in which relation it is being used is in running condition. Further, independent of factor whether the rotor shaft of the present disclosure being made of single piece or of multiple piece, the rotor shaft of the present disclosure is advantageous in withstanding or reducing effects of temperature and centrifugal or axial forces. The improved rotor shaft with such a cross-sectional profile is capable of exhibiting the total life cycle to be increased by 2 to 5 times of the conventional rotor in the discussed location. The rotor shaft of present disclosure is also advantageous in reducing the acting stresses in the area of the bore inlet by 10 to 40%. The acting stresses are a mixture of mechanical and thermal stresses. Further, the rotor shaft is convenient to use in an effective and economical way. Various other advantages and features of the present disclosure are apparent from the above detailed description and appendage claims.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, preferred or advantageously in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A rotor shaft adapted to rotate about a rotor axis of the rotor shaft, the rotor shaft comprising: a rotor cavity configured concentrically or quasi-concentrically to the rotor axis inside the rotor shaft, a plurality of cooling bores extending outward from the inside to an outside of the rotor shaft and towards a direction of rotation of the rotor shaft, each of the plurality of cooling bores having a bore inlet and a bore outlet, wherein the each of the plurality of cooling bores comprises a constant cooling bore diameter extending from the bore inlet to the bore outlet, the respective bore inlet being adapted to abut on the rotor cavity, and wherein at least one side or part-side of the circumferential area of the bore inlet is provided with an edge fillet in order to maximize a wall thickness downstream of the edge fillet between two adjacent cooling bores, and wherein the edge fillet of each of the plurality of cooling bores has a radius of 0.3 to 0.7 of the cooling bore diameter and an opposite side of the bore inlet is without an edge fillet, and wherein the edge fillet of each of the plurality of plurality of cooling bores is arranged on a front of the bore in the direction of rotation of the rotor shaft.

2. The rotor shaft according to claim 1, wherein the edge fillet of the cooling bore is a milled edge fillet.

3. The rotor shaft according to claim 1, wherein the rotor shaft is a member of a gas or steam turbine or a turbomachinery.

4. The rotor shaft according to claim 1, wherein the edge fillet has a depth and a width, and wherein the depth and the width of the edge fillet is 0.3 to 0.7 of the diameter of the cooling bore.

5. The rotor shaft according to claim 1, wherein the wall thickness abutting the rotor cavity between the rounded edge fillet of each of the plurality of cooling bores and the cooling bore inlet that is without the edge fillet is less than the constant cooling bore diameter.

6. A rotor shaft adapted to rotate about a rotor axis of the rotor shaft, the rotor shaft comprising:

a rotor cavity configured concentrically or quasi-concentrically to the rotor axis inside the rotor shaft; and a plurality of cooling bores extending outward from the inside to an outside of the rotor shaft and towards a direction of rotation of the rotor, each of the plurality of cooling bores having a cooling bore extending from a bore inlet to a bore outlet, the respective bore inlet being adapted to abut the rotor cavity, and wherein at least one side or part-side of the circumferential area of the bore inlet is provided with a rounded edge fillet having a radius of 0.3 to 0.7 of a diameter of the cooling bore and an opposite side of the bore inlet is without an edge fillet, and wherein the edge fillet of the each of the plurality of plurality of cooling bores is arranged on a front of the bore in the direction of rotation of the rotor.

7. The rotor shaft according to claim 6, wherein the rounded edge fillet of the cooling bore is a milled round edge fillet.

8. The rotor shaft according to claim 6, wherein the rotor shaft is a member of a gas or steam turbine or a turbomachinery.

9. The rotor shaft according to claim 6, wherein the rounded edge fillet has a depth and a width, and wherein the depth and the width of the rounded edge fillet is 0.3 to 0.7 of the diameter of the cooling bore.

10. The rotor shaft according to claim 6, wherein the wall thickness abutting the rotor cavity between the rounded edge fillet of each of the plurality of cooling bores and the cooling bore inlet that is without the edge fillet is less than the cooling bore diameter.

11. A rotor shaft adapted to rotate about a rotor axis of the rotor shaft, the rotor shaft comprising: a rotor cavity configured concentrically or quasi-concentrically to the rotor axis inside the rotor shaft; and a plurality of cooling bores extending outward from the inside to an outside of the rotor shaft and towards a direction of rotation of the rotor shaft, each of the plurality of cooling bores extending from a bore inlet to a bore outlet, the respective bore inlet being adapted to abut the rotor cavity, and wherein at least one side or part-side of the circumferential area of the bore inlet is provided with a rounded edge fillet having a radius of 0.3 to 0.7 of a diameter of the cooling bore and an opposite side of the bore inlet is without an edge fillet, and the edge fillet of the each of the plurality of cooling bores being arranged on a front of the bore in a direction of rotation of the rotor, and wherein a wall thickness abutting the rotor cavity between the rounded edge fillet of each of the plurality of cooling bores and the cooling bore inlet that is without the edge fillet is less than the cooling bore diameter.

12. The rotor shaft according to claim 11, wherein the rounded edge fillet of the cooling bore is a milled round edge fillet.

13. The rotor shaft according to claim 11, wherein the rotor shaft is a member of a gas or steam turbine or a turbo-machinery.

14. The rotor shaft according to claim 11, wherein the rounded edge fillet has a depth and a width, and wherein the depth and the width of the rounded edge fillet is 0.3 to 0.7 of the diameter of the cooling bore.

* * * * *